US005607233A

United States Patent [19]

Yant et al.

[11] Patent Number: 5,607,233

[45] Date of Patent: Mar. 4, 1997

[54] CONTINUOUS DYNAMIC MIXING SYSTEM

[75] Inventors: Robert E. Yant, Medina; Mark E. Piechuta, Alliance, both of Ohio

[73] Assignee: Quantum Technologies, Inc., Twinsburg, Ohio

[21] Appl. No.: 382,213

[22] Filed: Jan. 30, 1995

[51] Int. Cl.[6] ..... B01F 13/02

[52] U.S. Cl. ..... 366/102; 366/168.1; 366/182.2; 366/307; 261/122.1

[58] Field of Search ..... 366/262, 263, 366/264, 265, 307, 102, 103, 104, 168.1, 292, 293, 295, 101, 182.2, 279, 302; 415/55.1, 55.2, 55.3, 55.4, 55.5; 261/122.1, 123

[56] References Cited

U.S. PATENT DOCUMENTS

| | | | |
|---|---|---|---|
| 3,321,283 | 5/1967 | Ewald | 366/295 |
| 3,782,700 | 1/1974 | Wittrock . | |
| 3,936,240 | 2/1976 | Dochterman | 415/55.1 |
| 3,993,219 | 11/1976 | Franzosi . | |
| 4,032,117 | 6/1977 | Burgess . | |
| 4,037,826 | 7/1977 | Hulslander et al. . | |
| 4,075,712 | 2/1978 | Geyer | 366/79 |
| 4,098,640 | 7/1978 | Sander et al. . | |
| 4,231,664 | 11/1980 | Flock et al. | 366/35 |
| 4,261,685 | 4/1981 | Egli et al. | 415/55.3 |
| 4,279,570 | 7/1981 | Egli et al. | 415/55.3 |
| 4,850,704 | 7/1989 | Zimmerly et al. | 366/263 |
| 4,886,368 | 12/1989 | King | 366/155.1 |
| 4,900,480 | 2/1990 | Litz et al. | 261/123 |
| 4,941,752 | 7/1990 | Yant et al. | 366/307 |
| 5,248,223 | 9/1993 | Hill | 415/55.2 |

OTHER PUBLICATIONS

Bennington, C. P. J. et al., *Mixing in Pulp Bleaching*, Journal of Pulp and Paper Science, vol. 15(5)J186–195, Sep. 1989.

Lyons, E. J., *Practical Mixer Technology*, Chemical Engineering Progress, 44 No. 5, 341–346 (1948).

*Primary Examiner*—Tony G. Soohoo

*Attorney, Agent, or Firm*—Michael A. Centanni

[57] ABSTRACT

The present invention relates to a continuous dynamic mixing assembly comprising a pump assembly for motivating a fluid material into a mixing chamber and substantially preventing reverse flow of gas and/or fluid material and a continuous dynamic mixing chamber assembly for efficiently treating fluid material, the continuous dynamic mixing chamber comprising a cylindrical inner wall, elongated baffles coaxially extending along the major portion of the length of the inner wall, porous inserts for introducing gas into the mixing chamber and a multibladed agitator.

18 Claims, 4 Drawing Sheets

CONTINUOUS DYNAMIC MIXING SYSTEM

FIELD OF THE INVENTION

This invention is directed to a continuous dynamic mixing system for efficiently treating fluid material at substantially reduced energy requirements and to methods of operating same to realize particularly advantageous mixing results. More particularly, the invention is directed to a continuous dynamic mixing system comprising a fluid seal assembly for motivating a fluid material into a mixing chamber and substantially preventing reverse flow of gas and fluid material and a continuous dynamic mixing chamber assembly for effidently treating the fluid material at substantially reduced energy requirements.

BACKGROUND OF THE INVENTION

A wide variety of mechanical apparatus has been developed for use in the mixing of various solids/liquids suspension systems, such as paints and the like. The basic structure employed in the majority of such mixers can generally be described as some form of vessel for agitation; i.e., a tank or mixing chamber having one or more mechanically driven agitators or impellers mounted therein. Said agitators can vary widely in type, location, and method of mounting in a particular mixing chamber. However, the main mixing chamber in such equipment has most often been fabricated with a generally cylindrical shape. Stationary wall baffles are frequently mounted on the inside lateral surfaces of such cylindrical mixing chambers in order to modify the flow patterns created by the mechanically driven agitators employer therein, especially when said agitators are designed to rotate concentrically around the central axis of said cylindrical chambers.

The stationary baffles are usually uniform, elongated, rigid strips mounted longitudinally in the mixing chamber in a generally axial direction along or near the lateral wall thereof. Such baffles are usually solid parallel piped strips and are usually oriented so that a small axis thereof is aligned with radii of the mixing chamber. Basic teachings regarding the effectiveness of various types and sizes of agitators and baffles systems and how they tend to interact to achieve efficient mixing are available in technical literature such as the article by E. J. Lyons in Chemical Engineering Progress 44, p. 341 et seq (1948). The problem with the normal protruding baffles of the baffle arrangements of the prior art is that maximum constriction occurs along the full edge of the agitator blade causing a shearing action which tears the fluid material apart.

U.S. Pat. No. 4,941,752 disclosed an improvement in the performance of various types of mixing devices by using a unique system of wall baffles. These mixing devices have proven to be especially useful in mixing and reacting fluid material with a wide variety of fluid reagents. However, in order to achieve more efficient treating of the fluid material at substantially reduced energy requirements, additional improvements are necessary.

It is desirable to have a continuous dynamic mixing system for efficiently treating fluid material at substantially reduced energy requirements wherein such mixing system comprises a motivating means to motivate the fluid material into a mixing chamber and a mixing chamber for mixing and treating the fluid material.

SUMMARY OF THE INVENTION

In accordance with the present invention, there is provided a continuous dynamic mixing system for efficiently treating fluid material at substantially reduced energy requirements.

Further in accordance with the present invention, there is provided a continuous mixing system for continuous mixing operations which is suitable for rapidly mixing fluid material with gasses without substantially damaging the fluid material and particularly solid particulate contained therein.

Still further in accordance with the present invention, there is provided a pump assembly for motivating a fluid material into a mixing chamber and substantially preventing reverse flow of gas and/or fluid material comprising an inlet means, motivating means for motivating the flow of said fluid material in the opposite direction of the inlet means, and an outlet means.

Still further in accordance with the present invention, there is provided a continuous dynamic mixing chamber assembly for efficiently treating fluid material comprising a cylindrical inner wall, elongated baffles coaxially extending along the major portion of the length of the inner wall, porous inserts for introducing gas into the mixing chamber wherein the porous inserts are attached to the baffles, and a multibladed agitator.

Still further in accordance with the present invention, there is provided a continuous dynamic mixing system for efficiently treating fluid material comprising (a) a pump assembly for motivating a fluid material into a mixing chamber and substantially preventing reverse flow of gas and/or fluid material, the fluid seal assembly comprising (1) an inlet means having a diameter sufficient to allow the influx of the fluid material;

(2) motivating means for motivating the fluid material in the opposite direction of the inlet means when the motivating means creates a seal to gasses and fluid material in the reverse direction; and (3) an outlet means wherein the outlet means comprises an outlet port to provide a positive pressure for the exiting fluid material and wherein the outlet port is offset relative to the inlet port; and (b) a continuous dynamic mixing chamber assembly for efficiently treating the fluid material at substantially reduced energy requirements, the mixing assembly comprising:

(1) a mixing chamber having cylindrical inner wall wherein the inner wall comprises elongated baffles coaxially extending along the major portion of the length of the inner wall, the baffles having a uniform cross-sectional shape corresponding generally to a small geometric segment of a circle, the radius of which is substantially the same as that of the inner wall of the mixing chamber, with the rounded, substantially cylindrical surface of each baffle fired against the inner wall of the chamber and correspondingly the flat sides of the baffles facing inwardly;

(2) porous inserts for introducing gas into the mixing chamber wherein the porous insert is attached to the inwardly facing flat side of the baffles;

(3) a plurality of inlet and outlet means for introducing fluid materials into the mixing chamber; and (4) a multibladed agitator having generally rectangular shape blades, each of which is rigidly mounted at equally spaced positions on a common hub member which is concentrically rotatable within the mixing chamber by a suitable drive shaft engaging therewith, the dimensions of the blades being suitable to effect axial and radial mixing within the mixing chamber while reducing shear stresses within the fluid material. Still further in accordance with the invention, there is provided a continuous process for efficiently mixing liquids and/or gasses with the fluid materials optionally comprising solid material at significantly reduced energy requirements and reduced shear stresses to said fluid materials.

These and other aspects of the invention will become clear to those skilled in the art upon reading and understanding of the specification.

BRIEF DESCRIPTION OF THE DRAWINGS

The invention will be further described in connection with the attached drawing figures showing preferred embodiments of the invention including specific parts and arrangements of parts. It is intended that the drawing included as a part of this specification be illustrative of the preferred embodiment of the invention and should in no way be considered as a limitation on the scope of the invention.

DETAILED DESCRIPTION OF THE INVENTION

Figure 1:
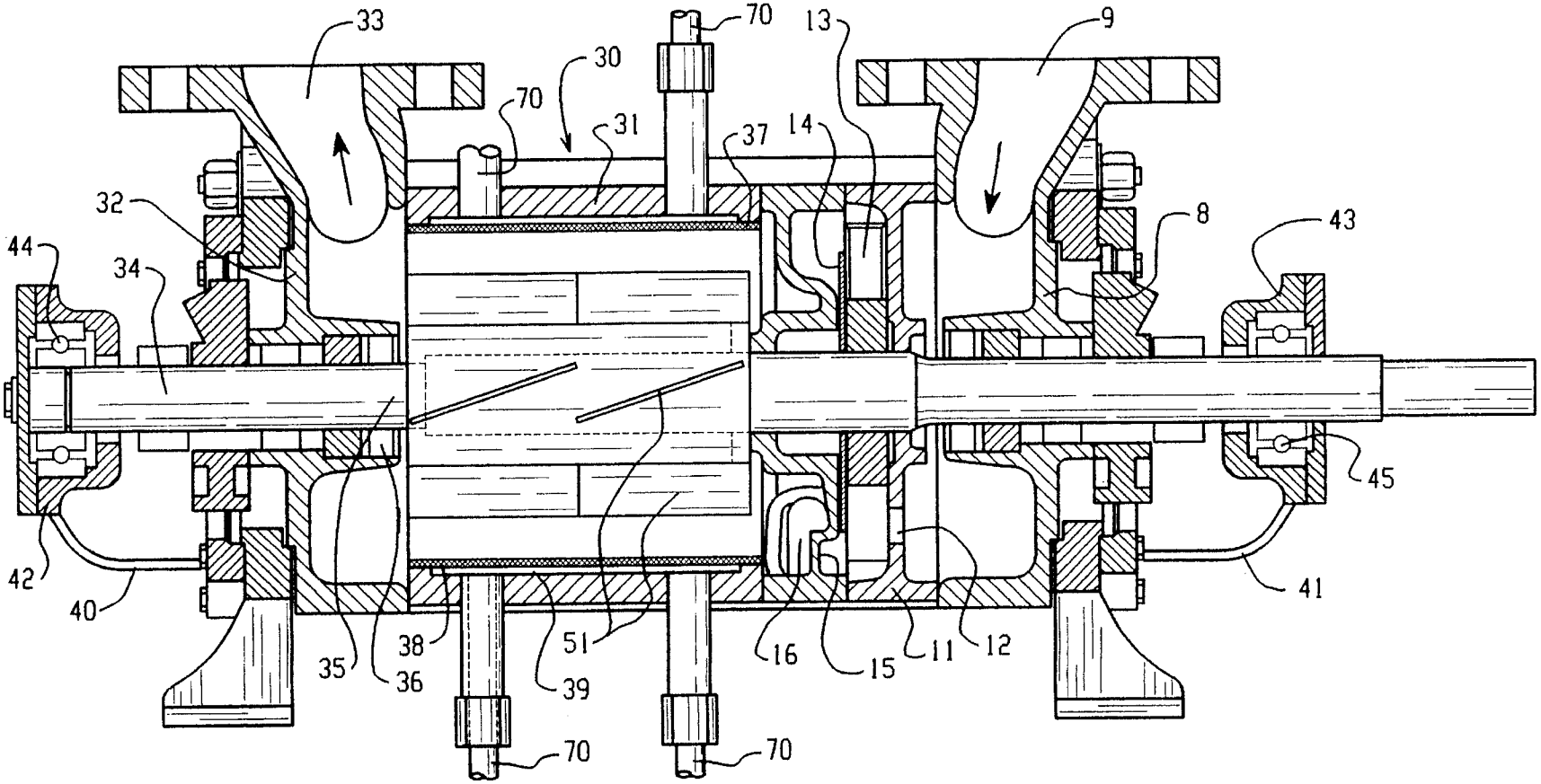
FIG. 1 is a side, sectional view of a continuous dynamic mixing system according to the present invention.

The continuous dynamic mixing system of the present invention as shown in FIG. 1 basically comprises a pump assembly for motivating a fluid material into a mixing chamber and substantially preventing reverse flow of gas and/or fluid material and a continuous dynamic mixing chamber assembly for efficiently treating fluid material. The pump assembly comprises an inlet means, motivating means for motivating the flow of said fluid material in the opposite direction of the inlet means, and an outlet means. The continuous dynamic chamber comprises a cylindrical inner wall, elongated baffles coaxially extending along the major portion of the length of the inner wall, porous inserts for introducing gas into the mixing chamber wherein the porous inserts are attached to the baffles, and a multibladed agitator.

The mixing system of the present invention may be used in mixing a wide variety of solids/liquids suspension systems, including simple relatively dilute and fluid suspensions approaching ideal Newtonian viscosity behavior as well as complex, relatively concentrated slurries which usually exhibit anomalous viscosity characteristics. The economically important reduction in power required to operate a given agitator, which is achieved by substituting the subject baffles for conventional ones, is particularly notable when the agitator is started up under load and/or when the solids/liquids suspension system is thixotropic.

Finely divided fibrous solids, such as pulped woody fibers, are especially likely to form highly thixotropic suspensions while undergoing purification and bleaching treatments. Since the energy inputs required to mix such materials with the liquid and/or gaseous chemical reactants involved are unusually high, special additional benefits accrue from using properly enclosed mixing equipment of this invention to effect such treatments. Thus, the thorough mixing needed to initiate uniform chemical reaction within the pulped fiber suspension can be quickly accomplished in the apparatus, using less power and with minimal physical damage to the fibers from the mechanical action generated by the impeller.

Figure 2:
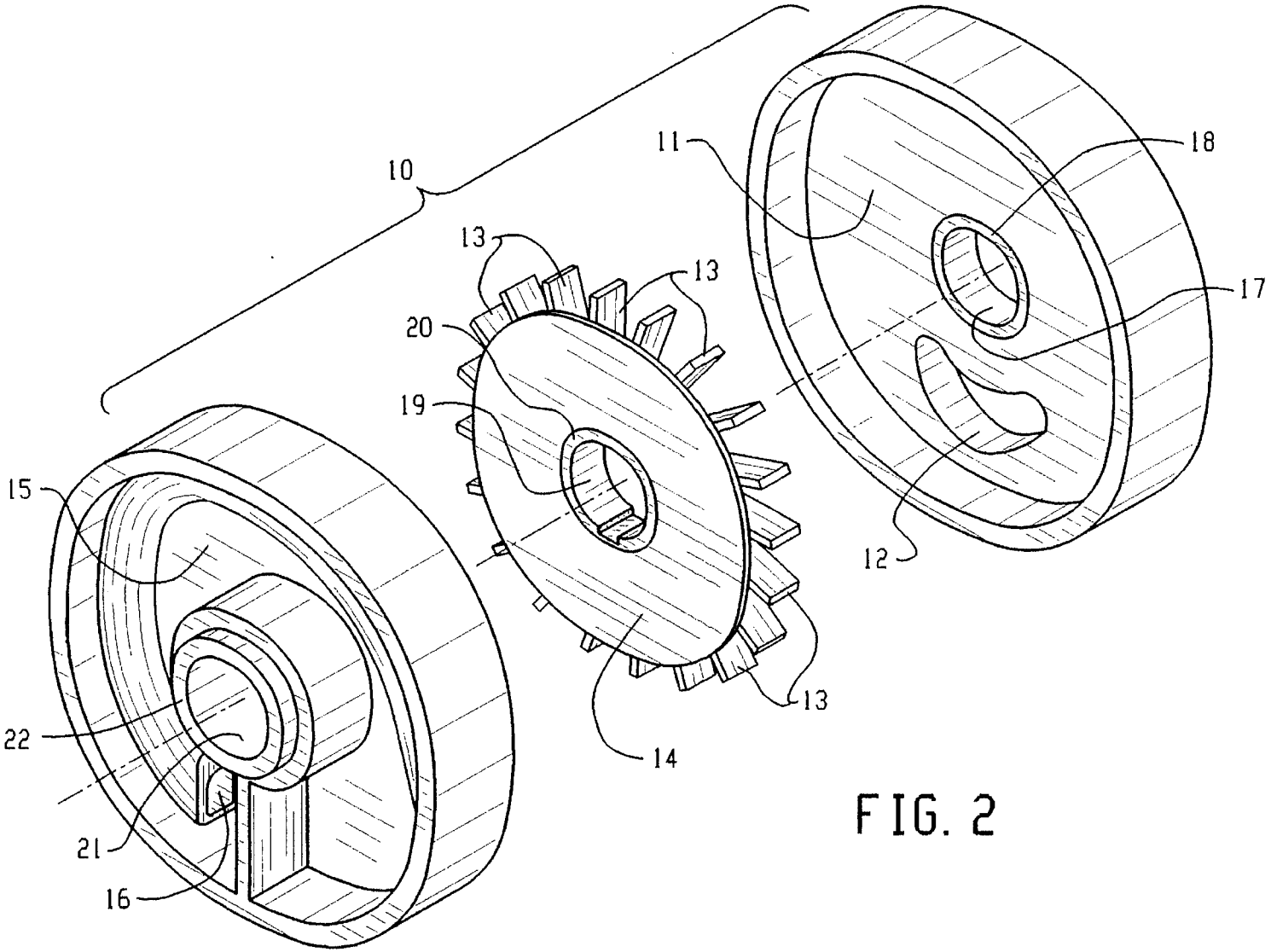
FIG. 2 is an exploded view of a pump assembly according to the present invention.

The continuous dynamic mixing system comprises a pump assembly 10 as shown in FIG. 2. Pump assembly 10 is disposed adjacent first end plate 8. End plate 8 has a inlet fitting 9 in communication with the pump assembly 10. Pump assembly 10 motivates a fluid material into the mixing chamber and substantially prevents the reverse flow of gas and/or fluid material. Pump assembly 10 is preferably oriented with its axis at least roughly horizontal. Pump assembly 10 is comprised of a face plate 11 having an inlet port 12 for the introduction of fluid material into pump assembly 10. The inlet port 12 is of sufficient diameter to allow the influx of fluid material into the pump assembly 10. Adjacent to the face plate 11 is a turbine plate 13 having a gas backflow plate 14. The turbine plate 13 is positioned so that the gas backflow plate 14 faces away from the face plate 11 and towards back plate 15. The back plate 15 has an outlet port 16 for the fluid material to exit pump assembly 10 and enter the continuous dynamic mixing chamber assembly 30. The outlet port 16 is positioned on back plate 15 so as to be offset from the inlet port 12 on the face plate 11. The outlet port 16 is tear shaped with the larger circular part of the tear shape being located on the surface of the back plate 15 facing the fluid seal assembly and the outlet port gradually narrowing as it extends through the back plate 15 to the mixing chamber 30.

In operation, fluid material is introduced into pump assembly 10 through inlet port 12 on face plate 11. The incoming fluid material is rotated in a radial direction by turbine plate 13. The rotation of the fluid material imparts a positive pressure onto fluid material which motivates the fluid material towards the outlet port 16. The gas backflow plate 14 prevents the flow of gaseous material back through the turbine plate towards the inlet port 12. Pump assembly 10 prevents the flow of fluid material out of the inlet port and further prevents the reverse flow of fluid material and gases out of the mixing chamber assembly.

Figure 3:
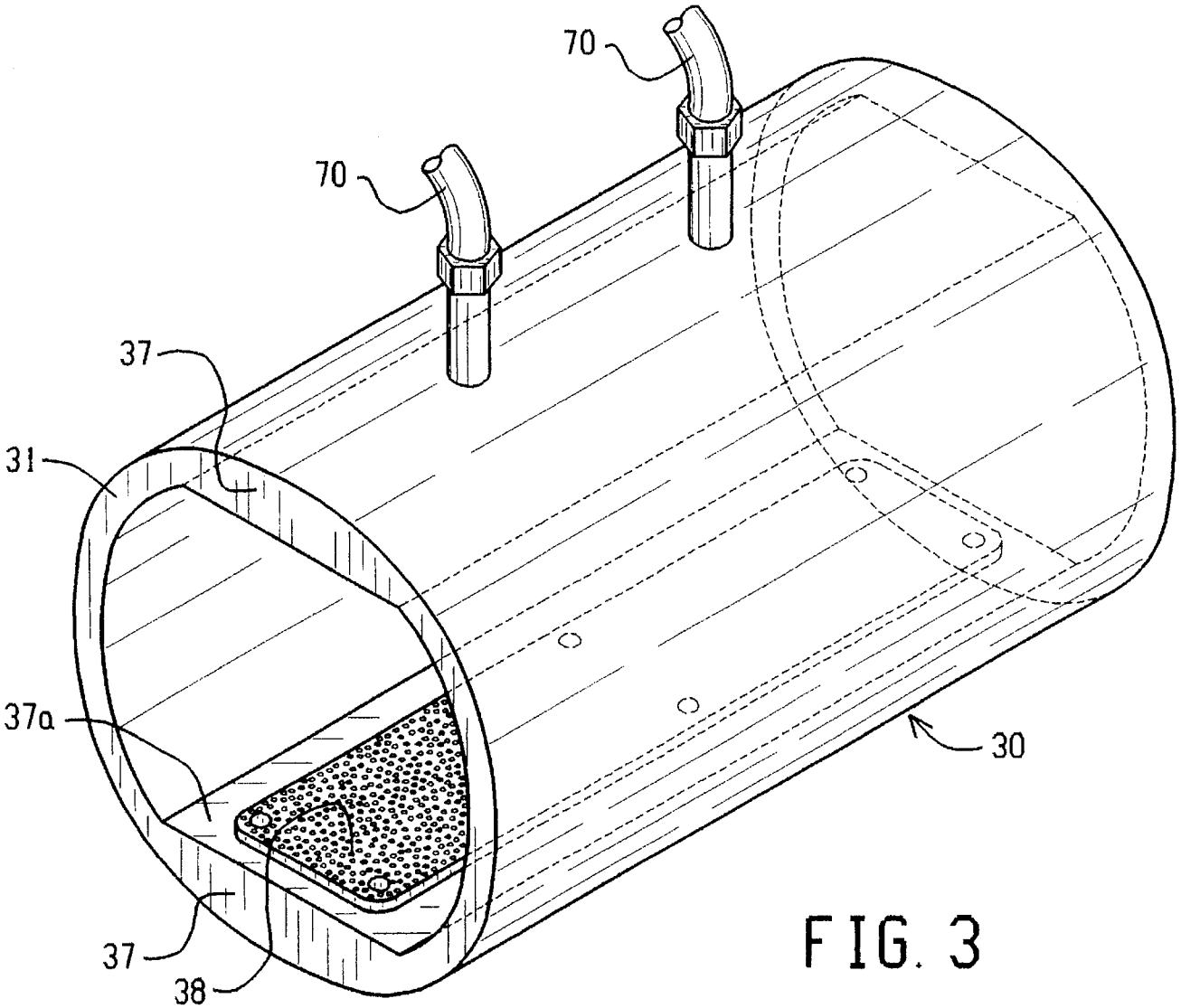
FIG. 3 is a perspective view of a continuous dynamic mixing chamber assembly according to the present invention.

The fluid material is introduced into the continuous dynamic mixing chamber assembly through outlet port 16 of back plate 15. The continuous dynamic mixing chamber assembly 30 as shown in FIG. 3 is preferably oriented with its axis at least roughly horizontal. One end of chamber 30 is joined in a pressure tight relationship with backplate 15 of pump assembly 10. The other end of chamber 30 is joined in a pressure tight relationship with second end plate 32. A discharge fitting 33 of adequate size is joined tightly to chamber 30 in close proximity second to end plate 32 to allow the treated fluid material to be steadily removed from the chamber 30. The length of chamber is preferably substantially greater than its inner diameter, usually about 1.5 times said diameter.

Drive shaft 34 extends from bearing housing 42 through mixing chamber 30 and through fluid seal assembly 10 to bearing housing 43. The drive shaft is supported by support bearing 44, 45 contained in bearing housings 42, 43 and is rigidly held in place by three struts 40, 41. Drive shaft 34 extends coaxially into chamber 30 through a sealable opening 35 in end plate 32 via suitable-seal fitting 36 and through a sealable opening 21 in back plate 15 via suitable seal fitting 22. Drive shaft 34 further extends coaxially through fluid seal assembly from the opening 21 in back plate 15, through a sealable opening 19 in turbine plate 13 via suitable seal fitting 20, through sealable opening 17 in face plate 11 via suitable seal fitting 18, and to bearing housing 43.

Figure 4:
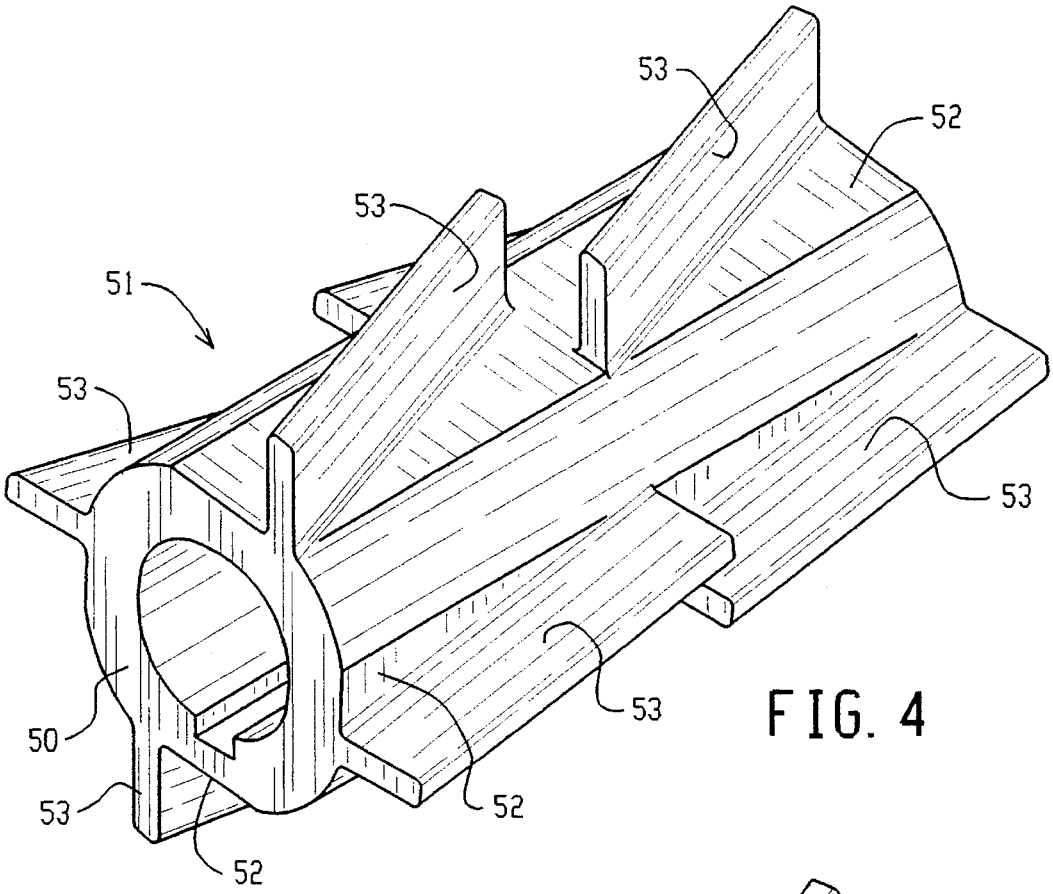
FIG. 4 is a perspective view of one embodiment of a multibladed agitator according to the present invention.

The portion of drive shaft 34 between second end plate 32 and back plate 15 is engaged with surrounding hub member 50 of agitator 51 as shown in FIG. 4. Hub member 50 has a roughly octagonal exterior, into flat sides 52 of which are rooted matching, equally spaced blades 53. The dimensions of the blades are such to effect suitable axial and radial mixing of the fluid material while reducing the shear stress within the fluid material.

Figure 5:
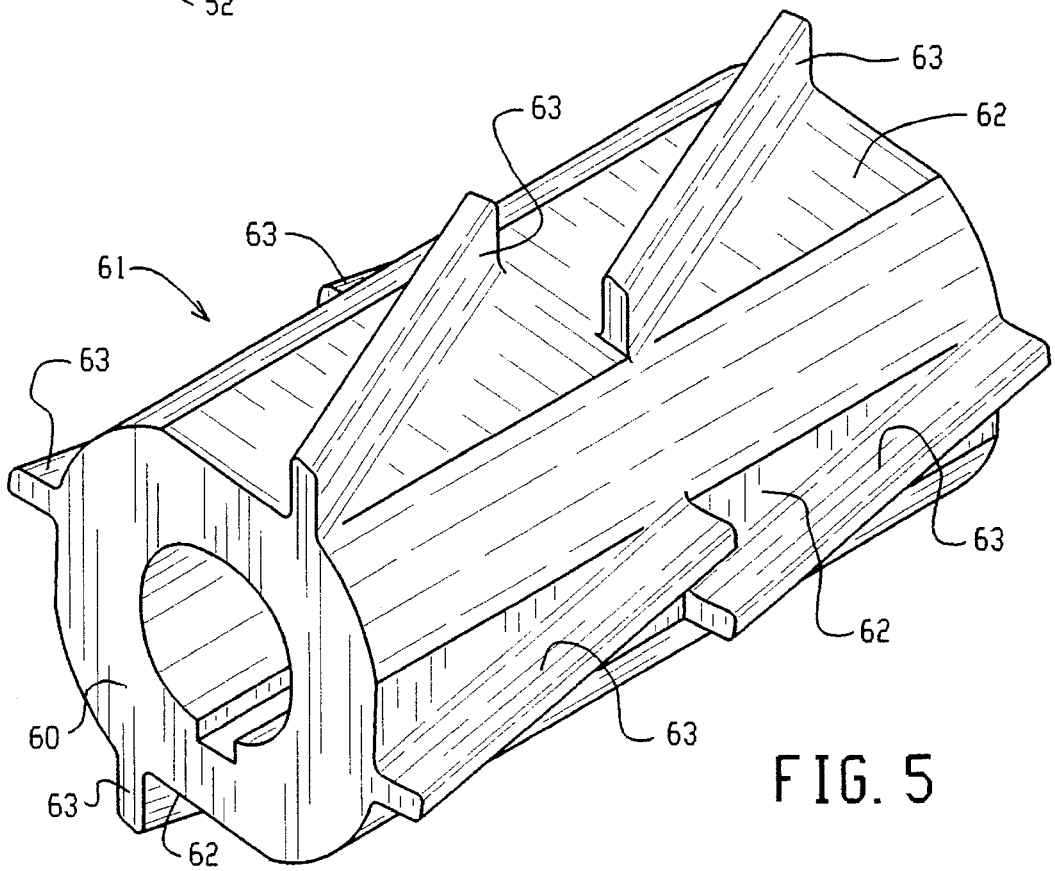
FIG. 5 is a perspective view of a second embodiment of a multibladed agitator according to the present invention.

In another embodiment as shown in FIG. 5, the portion of drive shaft 34 between second end plate 32 and back plate 15 is enclosed with surrounding hub member 60 of agitator 61. Hub member 60 has a roughly octagonal exterior, into flat sides 62 of which are rooted matching, equally spaced blades 63. In this embodiment, hub member 60 is larger and the blades 63 are smaller than those shown in FIG. 4. The larger hub member and smaller blades inhibits phase separation of the gas and liquid. In dynamic mixing systems gas present in the mixture has a tendency to move to the center of the mixture creating a gas phase and a fluid phase. The larger hub member and small agitator blades help to prevent such phase separations.

To promote better axial circulation, the agitator blades may be pitched at a small angle of about 5° to about 25°. Preferably, each of said blades is pitched at a clockwise professing angle of about 6° moving from the end near back plate 15. Each blade extends along substantially the full length of hub member 50. Blades 53 are substantially rectangular in shape, except for short tapered sections 54 at the ends near back plate 15. The angular pitch of blades 53 assists in attaining steady-state transport of material through chamber 30 when agitator 51 is rotated counterclockwise.

Chamber 30 is generally cylindrical in shape, and is defined by a cylindrical side wall 31. Side wall 31 includes opposed wall baffles 37. Baffles 37 are preferably formed as an integral part of side wall 31. Baffles 37 define opposed, planar surfaces 37*a*, best seen in FIG. 3. Wall baffles 37, have a generally cross-sectional shape of a circular segment. Preferably, the length of the baffles is substantially more than half that of said mixing chamber and the axial dimensions of the multibladed agitator is at least about half the length of the individual baffles. In a more preferred embodiment, the baffles run the full length of the mixing chamber, as shown in the drawings.

Mixing device 10 of the present invention has relatively narrow clearance gaps between the blade tips on the agitator and the thickest portion of the side wall 31, i.e., at the location of wall baffles 37. The gap between each baffle and the tips of the agitator blades varies according to the mass flow of fluid material through the mixing chamber. Preferably, the clearance gap between the blade tip and the thickest portion of the wall baffles 37 is about one-haft inch per 250 tons of fluid material processed per day. This minimum clearance between the agitator blades and the baffles occurs at only a single point along the rotor blade and not the full edge of the rotor blade as with rotor blades of the prior art and therefore, the minimal physical damage is done to the fluid material.

The maximum radial dimension or thickness of said baffles is an important consideration and can conveniently be specified in relation to the size of the mixing chamber. The maximum baffle thickness shotfid measure between about one-fortieth and about one-tenth of the inside diameter of the mixing chamber, corresponding to subtended angle sizes of the circular singmerit shaped baffles of between about 37° and about 74°. Preferably, the baffles have a maximum thickness of about one-thirtieth to about one-twelfth of the inside diameter of the mixing chamber, corresponding to subtended angle sizes of between about 42° and about 65°. In a more preferred embodiment, the sum total of the subtended angles is between about 90° and about 180°.

Each of the wall baffles 37 has a porous insert 38, for introducing gas into the mixing chamber. The porous strip 38 is inserted into a hollow chamber 39 formed into the inwardly facing flat surface 37*a* of the baffle 37. Gas is fed through gas inlets 70 into the hollow chamber 39 and passes through said porous insert 38 creating a fine layer of micro bubbles on the surface of the porous metal insert. The mixing action by the multibladed agitator 51 moves the fluid material ahead of it in a circular pattern, providing front to back mixing. The centrifugal force produced by the rotating agitator mixes the fluid material as it moves to the wall of the mixing chamber. The fluid material is accelerated to near the tip speed of the agitator as it passes through the constricted zone between the agitator blade tip and surface 37*a* of baffle 37, producing a venturi-like mixing action which sweeps the micro bubbles of porous insert 38 and into the fluid material. The agitator blades 51 cause the pulp material to sweep the micro bubbles into the mixing chamber 30 before they have an opportunity to coalesce and form larger bubbles. The advantage of the smaller bubbles is the much larger surface area compared to a single bubble producing efficient mixing of gas with the liquids and finely divided solids material. The porous insert 38 may be comprised of any material which has sufficient porosity for introducing gases into the mixing chamber. Preferably, the porous insert 38 is a metal plate. The porous insert is capable of introducing gas into the mixing chamber at a rate of about 2 scfm to about 1000 scfm.

The operating parameters of the continuous dynamic mixing system vary according to the dimensions of the mixing system, the type of fluid material to be treated, and other factors. For purposes of illustration only, the mixing system can process from about 1 to 2 tons per day to about 1,000 tons per day of gas/fluid material. The percent of solids in the fluid material can vary from no solids to 50% solids depending on the viscosity and density of the solids. The normal percentage of solids for a pulp solution would be from about 8% to about 12%. The viscosity of the fluid material to be processed can be from about 1 to 2 cp to about 1,000 cp. The range of particle sizes of the fluid materials to be processed vary according to the fluid material. The average particle length is from about 0.5 mm to about 5 mm. The average diameter is from about 9 um to about 40 um. The average molecular weight is from about 200 to about 4,000. The mixing system operates at speeds of about 600 RPM to about 3,600 RPM. The speed will vary depending on the diameter of the agitator such that the tip speed may be about 10 ft/sec to about 100 ft/sec. The mixing system can operate at pressures from about 0 psig to about 150 psig. The freeness value of the fluid material or pulp material exiting from the mixing chamber is about 750 to about 680.

Although various embodiments of the invention have been disclosed for illustrative purposes, it is understood that variations and modifications can be made by one skilled in the art without departing from the spirit or scope of the invention.

What we claim is:

1. A continuous dynamic mixing chamber assembly for efficiently treating a fluid material at substantially reduced energy requirements, comprising:

(a) a mixing chamber having a cylindrical inner wall which is generally symmetrical about a central axis, including elongated opposed baffles coaxially extending along the major portion of the length of said inner wall, said baffles having a uniform cross-sectional shape corresponding generally to a small geometric segment of a circle, said opposed baffles defining opposed, parallel, flat baffle surfaces;

(b) porous inserts for introducing gas into said mixing chamber wherein said porous inserts are attached to said inwardly facing flat side of said baffle surfaces;

(c) a plurality of inlet means for introducing gaseous materials into cavities defined in said baffles, said cavities defined between said inserts and said inner wall; and (d) a multibladed agitator having generally rectangular shaped blades, each of said blades being rigidly mounted at equally spaced positions on a common hub member which is concentrically rotatable within said mixing chamber by a suitable drive shaft engaging therewith, the dimensions of said blades being suitable to effect axial and radial mixing within said mixing chamber while reducing shear stresses within said fluid material.

2. The mixing assembly according to claim 1 wherein said porous insert is a metal plate having a porosity dimensioned to produce micro gas bubbles in the mixing chamber.

3. The mixing assembly according to claim 2 wherein said agitator blades are mounted on said common hub to provide a pitch to the blades and wherein the maximum constriction of said fluid material within said mixing chamber and said flat surfaces of said baffles will be at a point on said blades of said agitator as opposed to along the entire edge of said agitator blade.

4. The mixing assembly according to claim 1 wherein said flat surfaces of said baffles have a central, subtended angle of between about 37° to about 74°.

5. The mixing assembly according to claim 4 wherein the maximum thickness of said baffles is between about one-fortieth and about one-tenth of the inside diameter of said mixing chamber.

6. The mixing assembly according to claim 1 wherein said flat surfaces said baffles have a central, subtended angle of about 42° to about 65°.

7. The mixing assembly according to claim 6 wherein the maximum thickness of said baffles is between about one-thirtieth and about one-twelfth of the inside diameter of said mixing chamber.

8. The mixing assembly according to claim 1 wherein said baffles extend along substantially the full length of said inner wall and said agitator blades traverse about the same axial distance.

9. The mixing assembly according to claim 1 wherein said agitator blades traverse substantially the entire axial length of said chamber and are dimensioned to provide a clearance gap between the thickest dimension of said baffles along the vertical midline and the outer edges of said blades which is between about one-tenth to about one-fifth of the inner radius of said mixing chamber.

10. A continuous dynamic mixing device, comprised of:

an elongated mixer body having an internal mixing chamber formed within, said mixing chamber extending through said mixer body and having an inlet end for receiving material to be mixed and a discharge end for discharging mixed material;

a first portion of said mixing chamber being formed by a pair of opposed porous, gas permeable members, each of said porous members having a first surface communicating with, and forming a part of, said mixing chamber, and a second surface outside said mixing chamber, said first surfaces of said porous member having a predetermined spacing therebetween;

a second portion of said mixing chamber being formed by a pair of opposed portions of said mixer body, said portions of said mixing body having a spacing greater than said spacing between said porous members;

an elongated agitator disposed within said mixing chamber, said agitator being rotatable about an axis extending through said mixing chamber, said agitator being positioned between said porous members and having outward extending blades dimensioned to pass near said porous members; and at least one gas port communicating with said second surfaces of said porous members for introducing gas into said mixing chamber through said porous, gas permeable members.

11. A mixing device as defined in claim 10 wherein said mixing chamber is generally symmetrical about a central axis and wherein said porous members are elongated flat plates, extending parallel to said axis on opposite sides thereof, and said opposed portions of said mixer body are generally cylindrical in shape.

12. A mixing device as defined in claim 11 wherein said agitator rotates about said central axis and is symmetrical thereto.

13. A mixing device as defined in claim 11 wherein said mixing chamber is generally oblong in cross-section.

14. A mixing device as defined in claim 10 wherein said blades on said agitator are canted to direct said material from said inlet end to said outlet end.

15. A continuous mixing device for mixing liquids or solid/liquid mixtures with gaseous substances, comprising:

a fluid pressurizing assembly having a first plate and a second plate defining a pressurizing cavity therebetween, said first plate having an inlet opening for receiving said mixtures to be mixed, said inlet opening communicating with said pressurizing cavity, said second plate having an outlet opening;

a mixing assembly attached to said fluid pressurizing assembly, said mixing assembly having a mixer body defining an internal mixing chamber, said mixing chamber having an inlet end communicating with said outlet opening of said second plate of said fluid pressurizing assembly and an outlet end for discharging mixed substances from said mixing device, a portion of said mixing chamber being formed by a porous, gas permeable member, said gas permeable member having a first surface communicating with, and forming a part of, said mixing chamber and a second surface outside said mixing chamber, at least one gas port communicating with said second surface of said porous member for introducing a gaseous substance into said mixing chamber through said porous, gas permeable member;

a rotatable shaft extending through said mixing chamber and said pressurizing cavity;

a turbine element mounted to said shaft for rotation therewith said turbine element disposed within said pressurizing cavity and dimensioned to impart outward motion to said mixtures to increase its pressure to motivate said mixture through said outlet opening in said second plate; and an agitator mounted to said shaft for rotation therewith, said agitator disposed within said mixing chamber to mix pressurized substances from said fluid pressurizing assembly with gaseous substances from said gas port.

16. A mixing device as defined in claim 15 wherein said mixing assembly includes a second porous, gas permeable member, having a first surface communicating with, and forming a part of, said mixing chamber and a second surface outside said mixing chamber in communication with said gas port, said gas permeable member being generally flat plates and being disposed on opposite sides of said agitator.

17. A mixing device as defined in claim 16 wherein said mixing chamber in cross-section is generally oblong with said gas permeable members forming the narrow portion of the cross-section.

18. A mixing device as defined in claim 15 wherein said agitator includes blades dimensioned to pass near said gas permeable members.

* * * * *